US009293082B2

(12) United States Patent
Jeon

(10) Patent No.: US 9,293,082 B2
(45) Date of Patent: Mar. 22, 2016

(54) ORGANIC LIGHT-EMITTING DIODE DISPLAY

(71) Applicant: Samsung Display Co., Ltd., Yongin, Gyeonggi-Do (KR)

(72) Inventor: Jin Jeon, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/536,007

(22) Filed: Nov. 7, 2014

(65) Prior Publication Data

US 2015/0364083 A1 Dec. 17, 2015

(30) Foreign Application Priority Data

Jun. 17, 2014 (KR) ..... 10-2014-0073598

(51) Int. Cl.
*G09G 3/32* (2006.01)

(52) U.S. Cl.
CPC ..... *G09G 3/3225* (2013.01); *G09G 2300/0408* (2013.01); *G09G 2300/0417* (2013.01); *G09G 2300/0819* (2013.01); *G09G 2300/0852* (2013.01); *G09G 2300/0861* (2013.01); *G09G 2310/0221* (2013.01); *G09G 2310/0262* (2013.01); *G09G 2330/021* (2013.01)

(58) Field of Classification Search
None
See application file for complete search history.

(56) References Cited

U.S. PATENT DOCUMENTS

2012/0062536 A1 3/2012 Park
2013/0002632 A1* 1/2013 Choi ..... G09G 3/325 345/211
2013/0194248 A1 8/2013 Kim
2013/0201172 A1 8/2013 Jeong et al.
2013/0207117 A1* 8/2013 An ..... H01L 27/3276 257/71
2013/0222352 A1 8/2013 Jeong
2013/0334508 A1* 12/2013 Moon ..... H01L 51/5203 257/40
2014/0146029 A1* 5/2014 Hong ..... G09G 3/3233 345/212
2014/0198090 A1* 7/2014 Park ..... G09G 3/3291 345/212

FOREIGN PATENT DOCUMENTS

KR 10-2012-0028013 A 3/2012
KR 10-2013-0087128 A 8/2013
KR 10-2013-0091136 A 8/2013
KR 10-2013-0099588 A 9/2013

* cited by examiner

*Primary Examiner* — Seokyun Moon
(74) *Attorney, Agent, or Firm* — Knobbe Martens Olson & Bear LLP

(57) ABSTRACT

An organic light-emitting diode (OLED) display is disclosed. In one aspect, the display includes a display panel, a data driver, an emission control driver, a timing controller, a gate driver, an initialization driver, and a timing controller. The emission control driver is configured to sequentially apply an emission control signal to emission control lines, the emission control signal configured to determine a light emission period and a non-light emission period. The timing controller is configured to output a first start signal and a second start signal. The gate driver is configured to receive the first start signal from the timing controller, sequentially apply a gate initialization signal to gate initialization lines based on the first start signal, and sequentially apply a scan signal to the scan lines. The initialization driver is configured to receive the second start signal and sequentially apply an OLED initialization signal to the OLED initialization lines.

20 Claims, 9 Drawing Sheets

ORGANIC LIGHT-EMITTING DIODE DISPLAY

INCORPORATION BY REFERENCE TO ANY PRIORITY APPLICATIONS

This application claims priority from and the benefit of Korean Patent Applications No. 10-2014-0073598, filed on Jun. 17, 2014 in the Korean Intellectual Property Office (KIPO), the disclosure of which is hereby incorporated by reference herein in its entirety.

BACKGROUND

1. Field

The described technology generally relates to organic light-emitting diode displays.

2. Description of the Related Technology

Organic light-emitting diode (OLED) displays include OLEDs formed of a variety of organic materials that are laminated to emit light. Generally, an OLED display emits a variety of colors of light by adjusting current applied to the OLEDs.

A gate electrode of a drive transistor in a pixel and an anode electrode of the OLEDs are initialized (or, reset) in each frame to improve low response speed of the pixel and display colors of light more accurately. Generally, a scan signal, a gate initialization signal and an OLED initialization signal each having an active period corresponding to one period are generated in a gate driver, and are applied to the pixel. Initialization times to initialize the gate electrode of the drive transistor and the anode electrode of the OLED correspond to one horizontal period.

SUMMARY OF CERTAIN INVENTIVE ASPECTS

One inventive aspect is an OLED display including an initialization driver configured to output an OLED initialization signal having a longer active period than an active period of a scan signal.

Another aspect is an OLED display including a plurality of gate drivers and an initialization driver that is configured to output an OLED initialization signal having a longer active period than an active period of a scan signal.

Another aspect is a display device comprises a display panel including a plurality of scan lines, a plurality of gate initialization lines, a plurality of OLED initialization lines, a plurality of emission control lines, a plurality of data lines, and a plurality of pixels respectively having a plurality of OLEDs, a data driver configured to apply a plurality of data signals to the data lines, an emission control driver configured to sequentially apply an emission control signal to the emission control lines, the emission control signal determining a light emission period and a non-light emission period, a gate driver configured to receive a first start signal, to sequentially apply a gate initialization signal to the gate initialization lines based on the first start signal, and to sequentially apply a scan signal to the scan lines, an initialization driver configured to receive a second start signal, and to sequentially apply an OLED initialization signal to the OLED initialization lines based on the second start signal, a length of an active period of the second start signal being longer than a length of an active period of the first start signal, and a timing controller configured to control the data driver, the emission control driver, the gate driver and the initialization driver.

A length of an active period of the OLED initialization signal can be substantially the same as the length of the active period of the second start signal.

The timing controller can output the first start signal having the active period corresponding to one horizontal period to the gate driver, and outputs the second start signal to the initialization driver.

The timing controller can output the second start signal having an active level after two horizontal periods from when the timing controller outputs the first start signal having an active level.

When the gate initialization signal applied to one of the gate initialization lines becomes an inactive level, the gate driver can output the scan signal having an active level to one of the scan lines corresponding to the one of the gate initialization lines.

When the scan signal applied to the one of the scan lines becomes an inactive level, the initialization driver can output the OLED initialization signal having an active level to one of the OLED initialization lines corresponding to the one of the scan lines.

The length of the active period of the second start signal can be longer than one horizontal period, and shorter than a length of the non-light emission period.

A voltage level of the OLED initialization signal applied to each OLED initialization line can periodically transition between an active level and an inactive level during a predetermined time having a length substantially the same as a length of the active period of the second start signal.

The OLED initialization signal can transition from the inactive level to the active level in each horizontal period.

The timing controller can output the first start signal having an active period corresponding to one horizontal period to the gate driver, and outputs the second start signal to the initialization driver.

The timing controller can output the second start signal having an active level after two horizontal periods from when the timing controller outputs the first start signal having an active level.

When the gate initialization signal applied to one of the gate initialization lines becomes an inactive level, the gate driver can output the scan signal having an active level to one of the scan lines corresponding to the one of the gate initialization lines.

When the scan signal applied to the one of the scan lines becomes an inactive level, the initialization driver can output the OLED initialization signal having an active level to one of the OLED initialization lines corresponding to the one of the scan lines.

The length of the active period of the second start signal can be longer than one horizontal period, and shorter than a length of the non-light emission period.

Another aspect is an OLED display which comprises a display panel including a plurality of left scan lines, a plurality of right scan lines, a plurality of left gate initialization lines, a plurality of right gate initialization lines, a plurality of OLED initialization lines, a plurality of emission control lines, a plurality of data lines, and a plurality of pixels respectively having a plurality of OLEDs, a data driver configured to apply a plurality of data signals to the data lines, an emission control driver configured to sequentially apply an emission control signal to the emission control lines, the emission control signal determining a light emission period and a non-light emission period, a first gate driver configured to receive a first start signal, to sequentially apply a left gate initialization signal to the left gate initialization lines based on the first start signal, and to sequentially apply a left scan signal to the left scan lines, a second gate driver configured to receive the first start signal, to sequentially apply a right gate initialization signal to the right gate initialization lines based on the first start signal, and to sequentially apply a right scan signal to the right scan lines, an initialization driver configured to receive a second start signal, and to sequentially apply an OLED initialization signal to the OLED initialization lines based on the second start signal, a length of an active period of the second start signal being longer than a length of an active period of the first start signal, and a timing controller controlling the data driver, the emission control driver, the first gate driver, the second gate driver and the initialization driver.

A length of an active period of the OLED initialization signal can be substantially the same as the length of the active period of the second start signal.

The timing controller simultaneously can output the first start signal having an active level to the first gate driver and the second gate driver. The timing controller can output the second start signal having an active level after two horizontal periods from when the timing controller outputs the first start signal having the active level.

The first and second gate drivers simultaneously output the left and right scan signals to one of the left scan lines and one of the right scan lines, respectively. When the left and right scan signals applied to the one of the left scan lines and the one of the right scan lines become inactive levels, the initialization driver can output the OLED initialization signal having an active level to one of the OLED initialization lines corresponding to one of the left scan lines and the one of the right scan lines.

The length of the active period of the second start signal can be longer than one horizontal period, and shorter than a length of the non-light emission period.

A voltage level of the OLED initialization signal applied to each OLED initialization line can periodically transition between an active level and an inactive level during a predetermined time having a length substantially the same as a length of the active period of the second start signal. The length of the active period of the second start signal can be longer than one horizontal period, and shorter than a length of the non-light emission period.

Another aspect is an organic light-emitting diode (OLED) display comprising a display panel including a plurality of scan lines, a plurality of gate initialization lines, a plurality of OLED initialization lines, a plurality of emission control lines, a plurality of data lines, and a plurality of pixels respectively including a plurality of OLEDs. The OLED display also comprises a data driver configured to respectively apply a plurality of data signals to the data lines, an emission control driver configured to sequentially apply an emission control signal to the emission control lines, wherein the emission control signal is configured to determine a light emission period and a non-light emission period, and a timing controller configured to output a first start signal having a first active period and a second start signal having a second active period. The OLED display further comprises a gate driver configured to i) receive the first start signal from the timing controller, ii) sequentially apply a gate initialization signal to the gate initialization lines based at least in part on the first start signal, and iii) sequentially apply a scan signal to the scan lines, and an initialization driver configured to receive the second start signal and sequentially apply an OLED initialization signal to the OLED initialization lines based at least in part on the second start signal, wherein the second active period is longer than the first active period. Furthermore, the OLED display comprises a timing controller configured to control the data driver, the emission control driver, the gate driver, and the initialization driver.

In the above OLED display, the OLED initialization signal has a third active period having substantially the same duration as the second active period.

In the above OLED display, the first active period corresponds to one horizontal period. In the above OLED display, the timing controller is further configured to output the second start signal two horizontal periods after the first start signal is output.

In the above OLED display, when the gate initialization signal applied to a selected one of the gate initialization lines changes to an inactive level, the gate driver is further configured to transmit the scan signal to a selected one of the scan lines corresponding to the selected gate initialization line.

In the above OLED display, when the scan signal applied to the selected scan line changes to the inactive level, the initialization driver is further configured to transmit the OLED initialization signal to one of the OLED initialization lines corresponding to the selected scan line. In the above OLED display, the second active period is longer than one horizontal period and shorter than the non-light emission period.

In the above OLED display, the initialization driver is further configured to change a voltage level of the OLED initialization signal substantially periodically between the active level and the inactive level during a predetermined time substantially the same as the second active period. In the above OLED display, the initialization driver is further configured to sequentially change a plurality of the OLED initialization signals from the inactive level to the active level every horizontal period.

In the above OLED display, the timing controller is further configured to transmit the first start signal to the gate driver and the second start signal to the initialization driver. In the above OLED display, the timing controller is further configured to transmit the second start signal two horizontal periods after the first start signal is output. In the above OLED display, when the gate initialization signal applied to a selected one of the gate initialization lines changes to the inactive level, the gate driver is further configured to transmit the scan signal to a selected one of the scan lines corresponding to the selected gate initialization line.

In the above OLED display, when the scan signal applied to the selected scan line changes to the inactive level, the initialization driver is further configured to transmit the OLED initialization signal to one of the OLED initialization lines corresponding to the selected scan line. In the above OLED display, the second active period is longer than one horizontal period and shorter than the non-light emission period.

Another aspect is an organic light-emitting diode (OLED) display comprising a display panel including a plurality of first scan lines, a plurality of second scan lines, a plurality of first gate initialization lines, a plurality of second gate initialization lines, a plurality of OLED initialization lines, a plurality of emission control lines, a plurality of data lines, and a plurality of pixels respectively including a plurality of OLEDs. The OLED display also comprises a data driver configured to respectively apply a plurality of data signals to the data lines, an emission control driver configured to sequentially apply an emission control signal to the emission control lines, wherein the emission control signal is configured to determine a light emission period and a non-light emission period, and a timing controller configured to output a first start signal having a first active period and a second start signal having a second active period. The OLED display further comprises a first gate driver configured to i) receive the first start signal from the timing controller, ii) sequentially apply a first gate initialization signal to the first gate initialization lines based at least in part on the first start signal, and iii) sequentially apply a first scan signal to the first scan lines. Furthermore, the OLED display comprises a second gate driver configured to i) receive the first start signal, ii) sequentially apply a second gate initialization signal to the second gate initialization lines based at least in part on the first start signal, and iii) sequentially apply a second scan signal to the second scan lines. Also, the OLED display comprises an initialization driver, configured to receive the second start signal and sequentially apply an OLED initialization signal to the OLED initialization lines based at least in part on the second start signal, wherein the second active period is longer than first active period, and a timing controller configured to control the data driver, the emission control driver, the first gate driver, the second gate driver, and the initialization driver.

In the above OLED display, an active period of the OLED initialization signal is substantially the same as the second active period of the second start signal. In the above OLED display, the timing controller is further configured to substantially simultaneously transmit the first start signal to the first and second gate drivers, wherein the timing controller is further configured to transmit the second start signal two horizontal periods after the first start signal is output.

In the above OLED display, the first and second gate drivers are further configured to substantially simultaneously transmit the first and second scan signals to a selected one of the first scan lines and one of the second scan lines, respectively, wherein, when the first and second scan signals applied to the selected first and second scan lines become inactive levels, the initialization driver is configured to output the OLED initialization signal having the active level to one of the OLED initialization lines corresponding to the selected first and second scan lines.

In the above OLED display, the second active period is longer than one horizontal period, and shorter than the non-light emission period.

In the above OLED display, the initialization driver is further configured to change a voltage level of the OLED initialization signal substantially periodically between an active level and an inactive level during a predetermined time substantially the same as the second active period, wherein the second active period is longer than one horizontal period and shorter than the non-light emission period.

Therefore, the OLED display can include the initialization driver independently operated from the gate driver. The initialization driver can output the OLED initialization signal based on the second start signal. The active period of the OLED initialization signal is longer than typical active period, so that the OLED of the pixel can be initialized in a sufficient time, and residual voltage that has been applied previous frame to the OLED can be fully discharged. Thus, response speed of the pixel and an image blur problem can be improved. Especially, the response speed of the pixel emitting a green light that is most affected by the drive frequency can be greatly improved.

In addition, the OLED display can include the first and second gate drivers that simultaneously apply the left and right gate initialization signals and simultaneously apply the left and right scan signals to the display panel. Thus, RC time delay caused by loads and/or parasitic capacitances of signal lines in the display panel can decrease.

DETAILED DESCRIPTION OF CERTAIN INVENTIVE EMBODIMENTS

An initialization time of an anode of an organic light-emitting diode (OLED) (i.e., one horizontal period) is too short to fully initialize (or, fully discharge) a data voltage that is charged in the OLED during a previous frame. Especially, an OLED emitting green light is not fully initialized because of having lower response speed compared to OLEDs emitting red light or blue light. As a result, the displayed image can be blurry.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
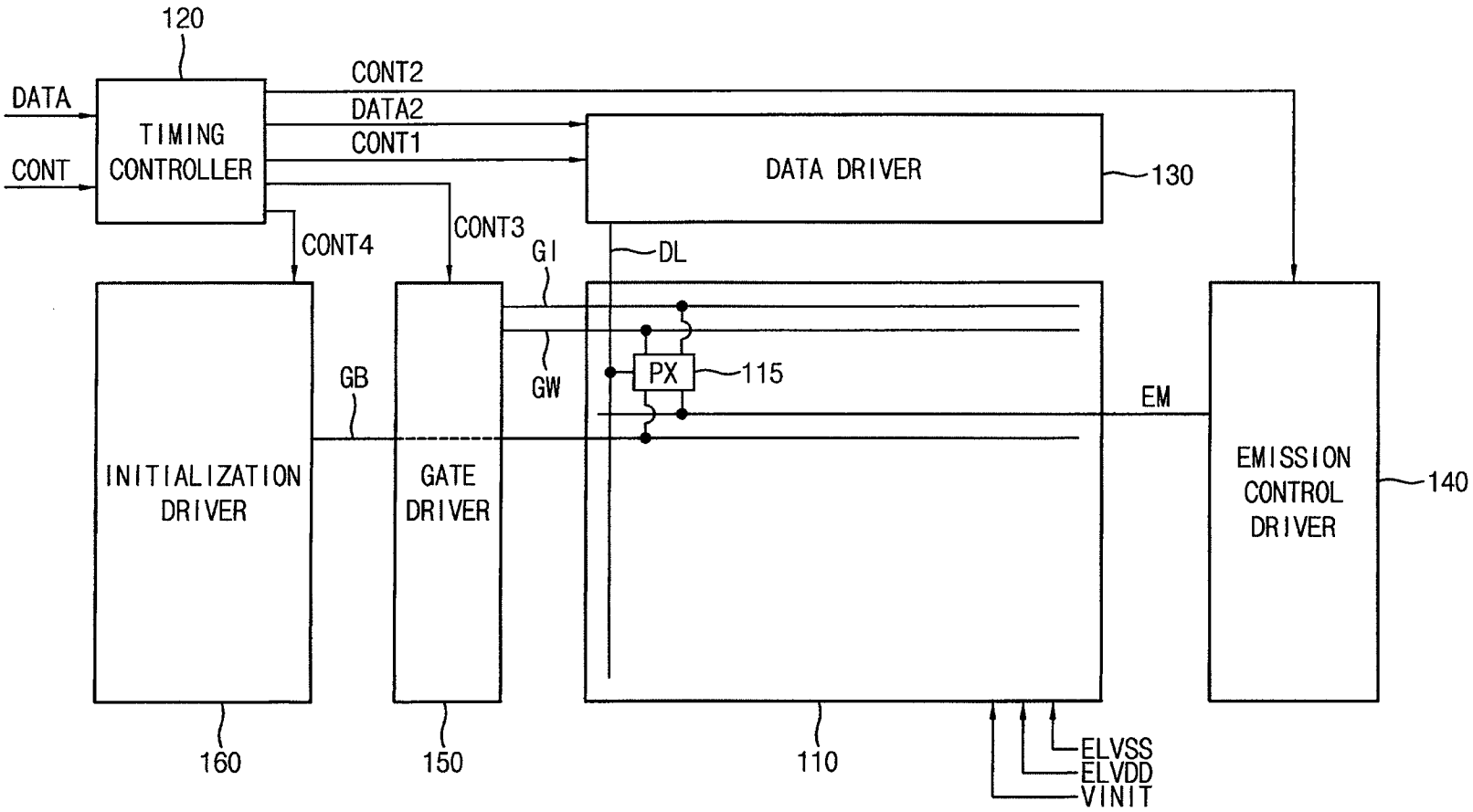
FIG. 1 is a block diagram of an OLED display according to example embodiments.

FIG. 1 is a block diagram of an OLED display according to example embodiments.

Referring to FIG. 1, the OLED display 100 includes a display panel 110, a data driver 120, an emission control driver 130, a gate driver 140, an initialization driver 150 and a timing controller 160.

The display panel 110 includes a plurality of scan lines GW, a plurality of gate initialization lines GI, a plurality of OLED initialization lines GB, a plurality of emission control lines EM, a plurality of data lines DL, and a plurality of pixels 115 respectively having a plurality of OLEDs. The pixels 115 can be formed in a matrix form. In an example embodiment, the number of the scan lines GW, gate initialization lines GI, OLED initialization lines GB, and emission control lines EM is n (n is an integer greater than 0.). The number of the data lines DL is m (m is an integer greater than 0.). In an example embodiment, the number of the pixels 115 is n×m.

In an example embodiment, a pixel 115 receives a first power supply ELVDD and a second power supply ELVSS from an external power supply unit (not shown), and generate light corresponding to a data signal DATA2. The pixel 115 can include a pixel circuit that is electrically connected to the OLED, the scan line GW, the gate initialization line GI, the OLED initialization line GB, and the emission control lines EM.

The timing controller 120 can control the data driver 130, the emission control driver 140, the gate driver 150, and the initialization driver 160. The timing controller 120 receives an input control signal CONT and an input image signal DATA from an image source such as an external graphic apparatus. The input control signal CONT can include a main clock signal, a vertical synchronizing signal, a horizontal synchronizing signal, and a data enable signal. The timing controller 120 can generate a data signal DATA2 which has a digital type and corresponds to operating conditions of the display panel 110 based at least in part on the input image signal DATA. The timing controller 120 can generate a first control signal CONT1 to control a driving timing of the data driver 130 based at least in part on the input control signal CONT. The timing controller 120 can generate second to fourth control signals CONT2, CONT3, and CONT4 to respectively control a driving timing of the emission control driver 140, the gate driver 150, and a driving timing of the initialization driver 160 based at least in part on the input control signal CONT. The timing controller 120 can respectively apply the second to fourth control signals CONT2, CONT3, and CONT4 to the emission control driver 140, the gate driver 150, and the initialization driver 160.

The third control signal CONT3 can include a first start signal, a first clock signal, and a second clock signal. The fourth control signal CONT4 can include a second start signal, the first clock signal, and the second clock signal. In an example embodiment, the timing controller 120 outputs the first start signal having an active period corresponding to one horizontal period to the gate driver 150, and outputs the second start signal to the initialization driver 160. The one horizontal period can be defined as a shift period between the first and second clock signals. In an example embodiment, the first and second clock signals have substantially the same period, and the second clock signal is obtained by shifting the first clock signal corresponding to a half of a period of the first clock signal. A length of one horizontal period can be adjusted by a drive frequency of the OLED display 100.

In an example embodiment, a length of the active period of the second start signal is longer than one horizontal period, and shorter than a length of the non-light emission period. For example, the length of the active period of the second start signal is above 2 horizontal periods and below the length of the non-light emission period minus 2 horizontal periods. For example, if the length of the non-light emission period is 50 horizontal periods, the active period of the second start signal corresponds a period between 2 horizontal periods and 48 horizontal periods.

The data driver 130 can convert the data signal DATA2 received from the timing controller 120 into a data voltage based at least in part on the first control signal CONT1. The data driver 130 can provide the data voltage to the data lines DL.

The emission control driver 140 can sequentially apply an emission control signal to the emission control lines EM based at least in part on the second control signal CONT2. An active period of the emission control signal can correspond to a light emission period of the pixel 115, and an inactive period of the emission control signal can correspond to a non-light emission period.

The gate driver 150 can receive the first start signal, sequentially apply a gate initialization signal to the gate initialization lines GI based at least in part on the first start signal, and sequentially apply a scan signal to the scan lines GW based at least in part on the first start signal. The gate initialization signal can control applying an initialization voltage VINIT that is applied to a gate electrode of a drive transistor of the pixel 115 to initialize the gate electrode. In an example embodiment, when the gate initialization signal applied to one of the gate initialization lines GI reaches an inactive level, the gate driver 150 outputs the scan signal having an active level to one of the scan lines GW corresponding to the one of the gate initialization lines GI. For example, an (n)th scan signal is obtained by shifting an (n)th gate initialization signal corresponding to one horizontal period.

The fourth control signal CONT4 can include the second start signal, the first clock signal, and the second clock signal. The initialization driver 160 can receive the fourth control signal CONT4 including the second start signal, and sequentially apply the OLED initialization signals to the OLED initialization lines GB based at least in part on the fourth control signal CONT4. The OLED initialization signal can control applying the initialization voltage VINIT that is applied to an anode electrode of the OLED of the pixel 115 to initialize the anode electrode of the OLED.

In an example embodiment, a length of an active period of the OLED initialization signal is substantially the same as the length of the active period of the second start signal. Thus, the OLED can be initialized, and residual voltage that has been applied to the OLED during the previous frame can be fully discharged.

In another example embodiment, a voltage level of the OLED initialization signal applied to each OLED initialization line GB substantially periodically transitions between the active level and the inactive level during a predetermined time having a length substantially the same as a length of the active period of the second start signal. The OLED initialization signal can transition from the inactive level to the active level in each horizontal period. Thus, the OLED can be initialized in a sufficient time, and residual voltage that has been applied to the OLED during the previous frame can be fully discharged. However, these are examples, and the length of the active period of the OLED initialization signal and the length of the inactive period of the OLED initialization signal are not limited thereto.

In an example embodiment, when the gate initialization signal applied to one of the gate initialization lines GI becomes the inactive level, the gate driver 160 outputs the scan signal having the active level to one of the scan lines GW corresponding to the one of the gate initialization lines GI. The pixel 115 can receive the gate initialization signal, the scan signal, and the OLED initialization signal, sequentially.

As described above, the OLED display 100 of FIG. 1 includes the initialization driver 160 independently operated from the gate driver 150. The initialization driver 160 can output the OLED initialization signal based at least in part on the second start signal, and the length of the active period of the OLED initialization signal can be longer than the length of the active period of the gate initialization signal and the scan signal. Therefore, response speed of the pixel 115 and an image blur problem can be improved. The response speed of the pixel emitting a green light that is most affected by the drive frequency can be greatly improved.

Figure 2:
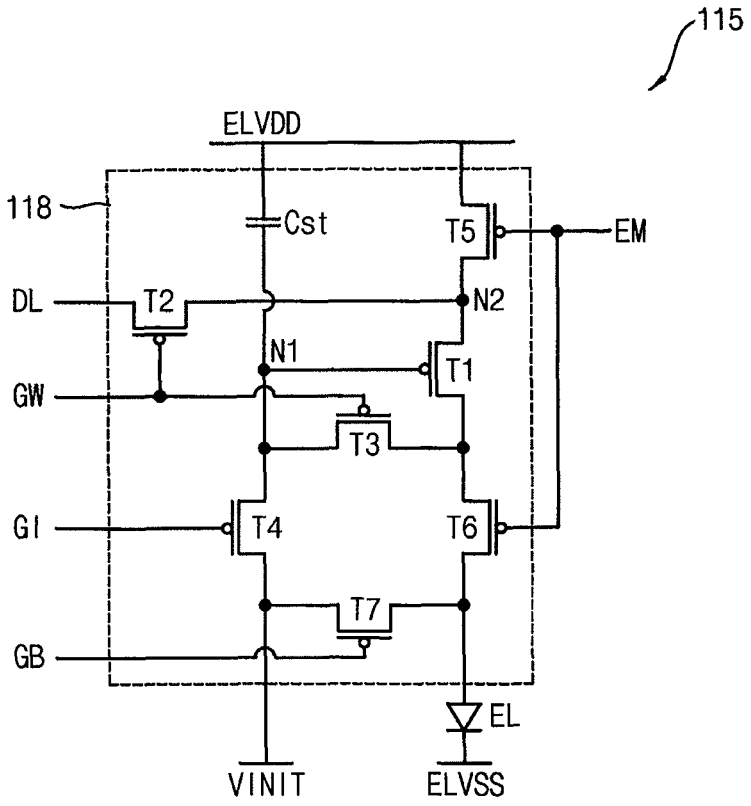
FIG. 2 is a circuit diagram illustrating an example of a pixel included in a display panel of the OLED display of FIG. 1.

FIG. 2 is a circuit diagram illustrating an example of a pixel included in a display panel of the OLED display 100 of FIG. 1.

Referring to FIG. 2, the pixel 115 includes an OLED EL and a pixel circuit 118 coupled to the data line DL, the gate initialization line GI, the scan line GW, and the emission control line EM to control the amount of current supplied to the OLED.

The anode electrode of the OLED EL is coupled to the pixel circuit 118 and a cathode electrode of the OLED EL is coupled to the second power supply ELVSS. The OLED EL can generate light with predetermined brightness to correspond to the amount of current supplied from the first power supply ELVDD via the pixel circuit 118.

The pixel circuit 118 can control the amount of current supplied to the OLED EL to correspond to a data signal. More specifically, the pixel circuit 118 includes first through seventh transistors T1 to T7 and a storage capacitor Cst.

The first transistor T1 can be a drive transistor. A first electrode of the first transistor T1 is coupled to a second node N2, a second electrode of the first transistor T1 is coupled to a first electrode of a sixth transistor T6, and a gate electrode of the first transistor T1 is coupled to a first node N1. The first transistor T1 can control the amount of current supplied to the OLED EL based at least in part on a voltage applied to the first node N1, that is, the voltage charged in the storage capacitor Cst.

The second transistor T2 includes a first electrode coupled to the data line DL, a second electrode coupled to the second node N2, and a gate electrode coupled to the scan line GW. When the scan signal having the active level is applied to the scan line GW, the second transistor T2 can be turned on to electrically couple the data line DL and the second node N2 to each other.

The third transistor T3 includes a first electrode coupled to the second electrode of the first transistor T1, a second electrode coupled to the first node N1, and a gate electrode coupled to the scan line GW. When the scan signal having the active level is applied to the scan line GW, the third transistor T3 can be turned on to electrically couple the gate electrode and the second electrode of the first transistor T1. In this case, the first transistor T1 is coupled in the form of a diode.

The fourth transistor T4 is coupled between the first node N1 and an initialization power supply applying an initialization voltage VINIT. The gate electrode of the fourth transistor T4 is coupled to the gate initialization line GI. The fourth transistor T4 can be turned on to apply the initialization voltage VINIT to the first node N1 when the gate initialization signal having the active level is applied to the gate initialization line GI. Thus, the gate electrode of the first transistor T1 can be initialized. Here, the initialization voltage VINIT is set to have a lower voltage than the data signal.

The fifth transistor T5 includes a first electrode coupled to the first power supply ELVDD, a second electrode coupled to the second node N2, and a gate electrode coupled to the emission control line EM. The sixth transistor T6 includes a first electrode coupled to the second electrode of the first transistor T1, a second electrode coupled to the anode electrode of the OLED EL, and a gate electrode coupled to the emission control line EM. The fifth and sixth transistors T5 and T6 can be turned on when the emission control signal having the active level is applied to the emission control line EM and be turned off when the emission control signal having the inactive level is not applied.

The seventh transistor T7 includes a first electrode coupled to the initialization power supply, a second electrode coupled to the anode electrode of the OLED EL, and a gate electrode coupled to the OLED initialization line GB. The seventh transistor T7 can be turned on to apply the initialization voltage VINIT to the anode electrode of the OLED EL when the OLED initialization signal having the active level is applied to the OLED initialization line GB. Thus, the anode electrode of the OLED EL can be initialized. In an example embodiment, each OLED is formed of different organic materials emitting different colors of light such as a red light, a green light, or a blue light. Characteristics of the organic materials emitting different colors of light are different such that initialization speeds can be different with the drive frequency. Thus, the initialization voltage VINIT must be applied to the anode electrode of the OLED EL in a sufficient time to fully discharge residual voltage that has been applied to the OLED EL during the previous frame.

The storage capacitor Cst is coupled between the first node N1 and the first power supply ELVDD. The storage capacitor Cst can charge a voltage determined by the data signal and the threshold voltage of the first transistor T1.

Figure 3:
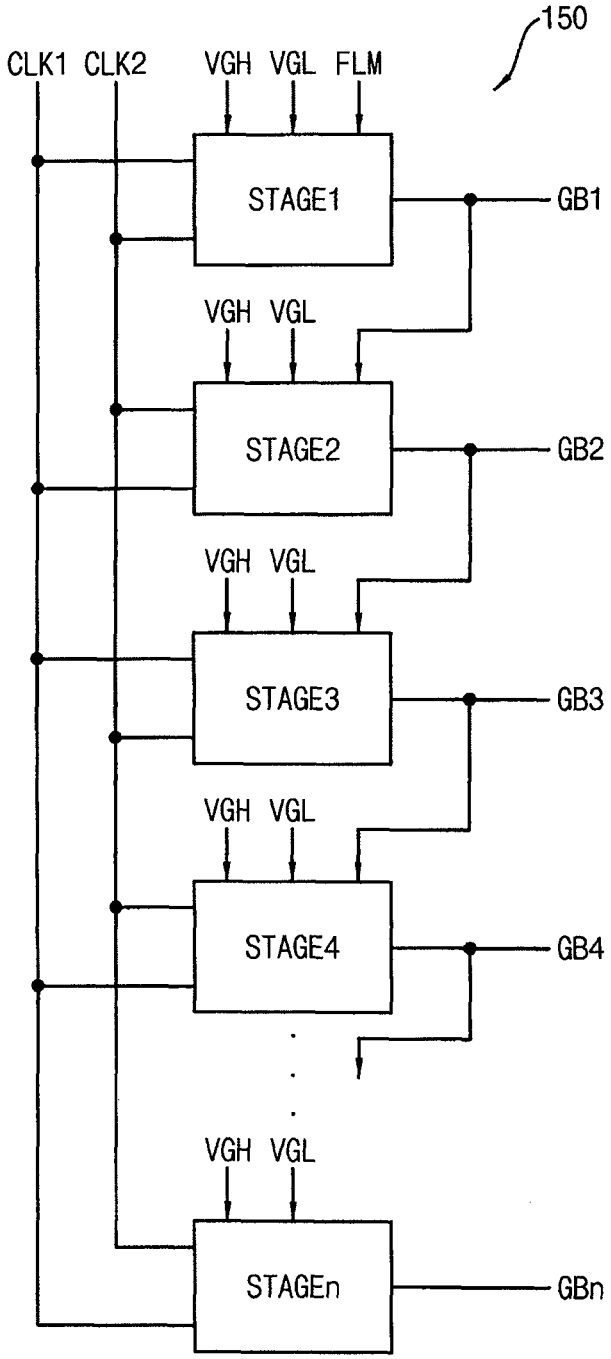
FIG. 3 is a block diagram illustrating an example of an initialization driver included in the OLED display of FIG. 1.

FIG. 3 is a block diagram illustrating an example of an initialization driver included in the OLED display 100 of FIG. 1.

Referring to FIG. 3, the initialization driver 150 includes a plurality of stages STAGE1, STAGE2, STAGE3, STAGE4, . . . STAGEn electrically connected to one another. The stages STAGE1 to STAGEn are respectively coupled to a plurality of OLED initialization lines. The stages STAGE1 to STAGEn sequentially apply OLED initialization signals GB1, GB2, GB3, GB4, . . . GBn to the OLED initialization lines, respectively Each stage STAGE1 to STAGEn receives a first DC voltage VGL and a second DC voltage VGH higher than the first DC voltage VGL. Each stage STAGE1 to STAGEn receives a first clock signal CLK1 and a second clock signal CLK2. The first and second clock signals CLK1 and CLK2 can have substantially the same period. The second clock signal CLK2 can be obtained by shifting the first clock signal CLK1 by half of the period of the first clock signal CLK1. In adjacent stages, the first and second clock signals CLK1 and CLK2 are inverted. The OLED initialization signals GB1 to GB-N each having the active level can be sequentially outputted at a time interval corresponding to the half of the period of the first clock signal CLK1 (i.e., a time interval of one horizontal period).

A first stage STAGE1 can be operated by receiving a start signal FLM having the active level. The first stage STAGE1 can receive the first and second DC voltages VGL and VGH, and can generate a first OLED initialization signal GB1 based at least in part on the start signal FLM, the first clock signal CLK1, and the second clock signal CLK2. The first OLED initialization signal GB1 can be applied to pixels arranged in a corresponding row through the first OLED initialization line.

The stages STAGE2 to STAGEn are connected to each other one after another and are sequentially driven. For example, a second stage STAGE2 receives the first OLED initialization signal GB1 from a previous stage (i.e., the first stage STAGE1). The second stage STAGE2 receives the first and second DC voltages VGL and VGH, and generates a second OLED initialization signal GB2 based at least in part on the first OLED initialization signal GB1, the first clock signal CLK1, and the second clock signal CLK2. The other stages STAGE3 to STAGEn can be driven in substantially the same way as the second stage STAGE2, and thus details thereof will not be repeated.

Figure 4:
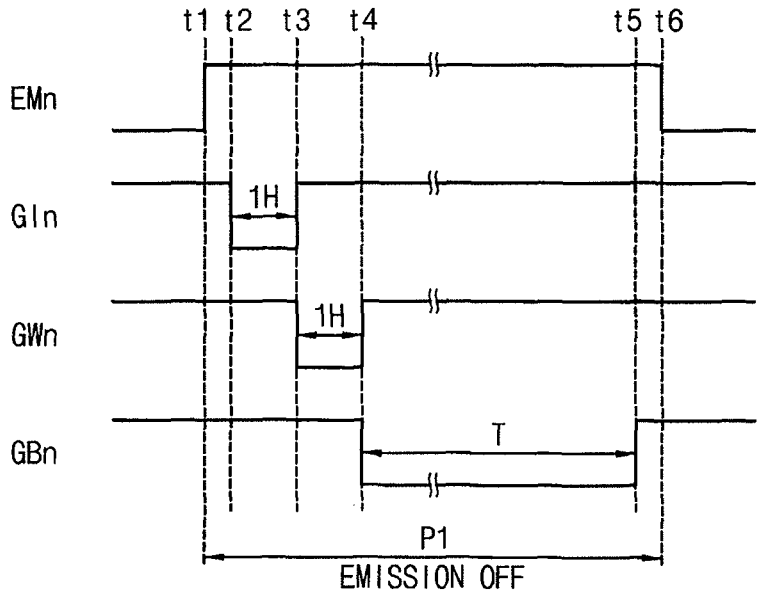
FIG. 4 is a timing diagram illustrating an example of signals applied to a display panel included in the OLED display of FIG. 1.

FIG. 4 is a timing diagram illustrating an example of signals applied to the display panel 110 included in the OLED display 100 of FIG. 1.

Referring to FIG. 4, an (n)th (n is a integer greater than 0) gate initialization signal GIn, an (n)th scan signal GWn, and an (n)th OLED initialization signal GBn are sequentially applied to pixels arranged in a corresponding row during a non-light emission period P1 of one frame. The (n)th gate initialization signal GIn and the (n)th scan signal GWn are generated in an (n)th stage of the gate driver 150. The (n)th OLED initialization signal GBn can be generated in an (n)th stage of the initialization driver 160.

Hereinafter, the operation of the OLED display 100 will be explained with the OLED display 100 including PMOS (P-channel metal oxide semiconductor) transistors. A high level of each signal is referred to as the inactive level, and a low level, lower than the high level, of each signal is referred to as the active level. However, these are examples, and the operation of the OLED display 100 is not limited thereto. For example, NMOS (N-channel metal oxide semiconductor) transistors can be applied to the OLED display 100.

The non-light emission period P1 corresponds to an inactive period of an (n)th emission control signal EMn. In some embodiments, during the non-light emission period P1, the OLED does not emit light. The (n)th gate initialization signal GIn, the (n)th scan signal GWn, and the (n)th OLED initialization signal GBn can sequentially have the active level during the non-light emission period P1. In an example embodiment, the length of the non-light emission period P1 is about 10% of the number of scan lines. For example, if the display panel 110 includes 1920 scan lines, the length of the non-light emission period P1 corresponds to about 192 horizontal periods. However, this is an example, and the length of the non-light emission period P1 is not limited thereto.

At a first time point t1, the (n)th emission control signal EMn changes from the active level to the inactive level. In an example embodiment, the (n)th gate initialization signal GIn, the (n)th scan signal GWn, and the (n)th OLED initialization signal GBn have the inactive level.

At a second time point t2, the (n)th gate initialization signal GIn changes from the inactive level to the active level. The (n)th scan signal GWn, and the (n)th OLED initialization signal GBn have the inactive level. An active period of the (n)th gate initialization signal GIn corresponds to one horizontal period 1H. The one horizontal period 1H corresponds to about half of a period of the first clock signal (or the second clock signal). The (n)th gate initialization signal GIn can change from the active level to the inactive level after one horizontal period 1H from the second time point t2. In an example embodiment, the second time point t2 is substantially the same as the first time point t1. In this case, when the (n)th emission control signal EMn changes from the active level to the inactive level, the (n)th gate initialization signal GIn changes from the inactive level to the active level.

At a third time point t3, the (n)th gate initialization signal GIn changes from the active level to the inactive level, and the (n)th scan signal GWn changes from the inactive level to the active level. The (n)th OLED initialization signal GBn can still have the inactive level. An active period of the (n)th scan signal GWn can correspond to one horizontal period 1H. The gate driver 150 can output the (n)th gate initialization signal GIn and the (n)th scan signal GWn such that the length of the active period of the (n)th gate initialization signal GIn and the length of the active period of the (n)th scan signal GWn is substantially the same. The (n)th scan signal GWn changes from the active level to the inactive level after one horizontal period 1H from the second time point t3.

At a fourth time point t4, the (n)th scan signal GWn changes from the active level to the inactive level, and the (n)th OLED initialization signal GBn changes from the inactive level to the active level. The (n)th gate initialization signal GIn has the inactive level.

At a fifth time point t5, the (n)th OLED initialization signal GBn changes from the active level to the inactive level. An active period of the (n)th OLED initialization signal GBn corresponds to a time period from the fourth time point t4 to the fifth time point t5. A length of the active period of the (n)th OLED initialization signal GBn (as represented T) can be longer than one horizontal period 1H, and shorter than the length of the non-light emission period P1. In an example embodiment, the length of the active period of the (n)th OLED initialization signal GBn (as represented T) is above 2 horizontal periods and below the length of the non-light emission period P1 minus 2 horizontal periods. The relationship can be represented by the following equation.

$$2H \le T \le P1 - 2H \qquad \text{Equation 1}$$

The active period T of the (n)th OLED initialization signal GBn is longer than a typical active period, so that the OLED of the pixel is initialized in a sufficient amount of time. The residual voltage that has been applied to the OLED during the previous frame can be fully discharged.

At a sixth time point t6, the (n)th emission control signal EMn changes from the inactive level to the active level. In an example embodiment, the sixth time point t6 is substantially the same as the fifth time point t5. In this case, when the (n)th emission control signal EMn changes from the inactive level to the active level, the (n)th OLED initialization signal GBn changes from the active level to the inactive level.

Figure 5:
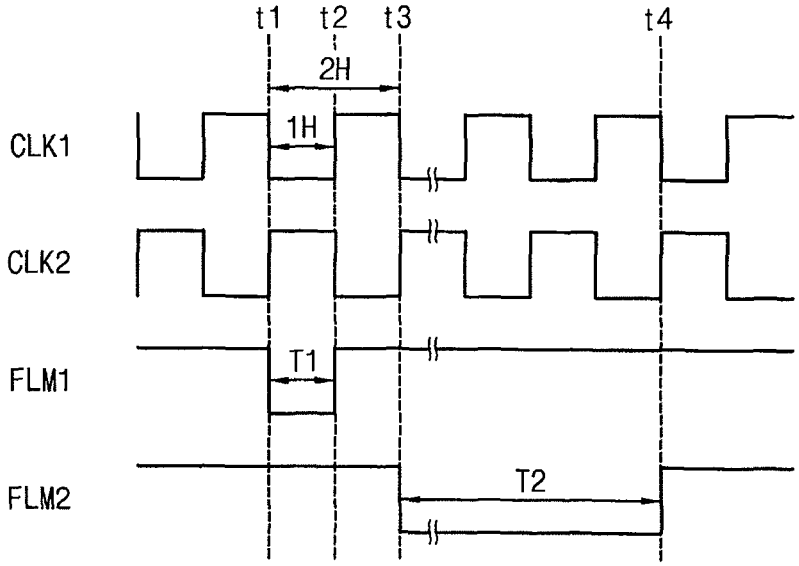
FIG. 5 is a timing diagram illustrating an example of an operation of a timing controller included in the OLED display of FIG. 1.

FIG. 5 is a timing diagram illustrating an example of an operation of the timing controller 120 included in the OLED display 100 of FIG. 1.

Referring to FIGS. 1 to 3, and 5, the timing controller 120 outputs the first clock signal CLK1, the second clock signal CLK2, and the first start signal FLM1 to the gate driver 150. The timing controller 120 outputs the first clock signal CLK1, the second clock signal CLK2, and the second start signal FLM2 to the initialization driver 160.

In an example embodiment, the first and second clock signal CLK1 and CLK2 have substantially the same period, and the second clock signal CLK2 can be obtained by shifting the first clock signal CLK1 by half of the period of the first clock signal CLK1. The half of the period of the first clock signal CLK1 corresponds to one horizontal period 1H. A length of an active period T1 of the first start signal FLM1 and a length of an active period T2 of the second start signal FLM2 can be determined by a length of an active period of the first clock signal CLK1 and/or the second clock signal CLK2. In an example embodiment, at a first time point t1, the first clock signal CLK1 changes from the inactive level to the active level, and the second clock signal CLK2 change from the active level to the inactive level. At a second time point t2, the first clock signal CLK1 changes from the active level to the inactive level, and the second clock signal CLK2 changes from the inactive level to the active level. A time period between the first and second time points t1 and t2 corresponds to one horizontal period 1H. The length of one horizontal period 1H can be controlled by a drive frequency for driving the OLED display 100.

In an example embodiment, the timing controller 120 outputs the first start signal FLM1 having the active period corresponding to the one horizontal period 1H to the gate driver 150. For example, at the first time point t1, the first start signal FLM1 changes from the inactive level to the active level. At the second time point t2, the first start signal FLM1 changes from the active level to the inactive level. The first start signal FLM1 has the active level from the first time point t1 to the second time point t2. The second start signal FLM2 can have the inactive level from the first time point t1 to the second time point t2.

The timing controller 120 can output the second start signal FLM2 to the initialization driver 160. The timing controller 120 can set the length of the active period T2 of the second start signal FLM2 longer than the length of the active period T1 of the first start signal FLM1. In an example embodiment, the length of the active period T2 of the second start signal FLM2 is longer than the one horizontal period 1H, and shorter than a length of the non-light emission period. For example, if the length of the non-light emission period is 50 horizontal periods, the active period of the second start signal corresponds to a period between 2 horizontal periods and 48 horizontal periods.

In an example embodiment, a length of an active period of an OLED initialization signal generated by the second start signal FLM2 is substantially the same as the length of the active period of the second start signal FLM2. In another example embodiment, a voltage level of the OLED initialization signal applied to each OLED initialization line substantially periodically transitions between the active level and the inactive level during a predetermined time having a length substantially the same as the length of the active period of the second start signal FLM2.

In an example embodiment, the timing controller 120 outputs the second start signal FLM2 having the active level after a predetermined time from when the timing controller 120 outputs the first start signal FLM1 having the active level. For example, the timing controller 120 outputs the second start signal FLM2 having the active level after two horizontal periods 2H from when the timing controller 120 outputs the first start signal FLM1 having the active level. At a third time point t3, the second start signal FLM2 changes from the inactive level to the active level. At a fourth time point t4, the second start signal FLM2 changes from the active level to the inactive level. A time period between the third and fourth time points t3 and t4 corresponds to the active period of the second start signal FLM2. The first start signal FLM1 can have the inactive level from the first time point t3 to the second time point t4.

The gate driver 150 and the initialization driver 160 can be respectively driven by the first start signal FLM1 and the second start signal FLM2.

Figure 6:
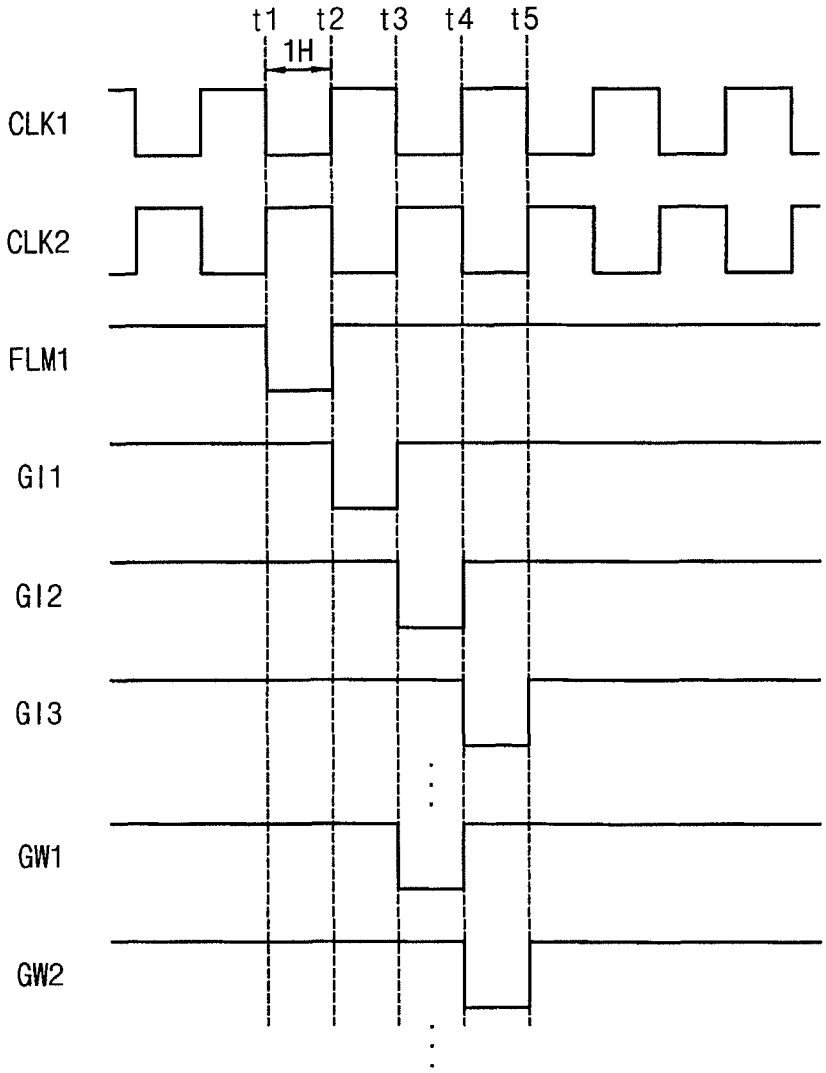
FIG. 6 is a timing diagram illustrating an example of an operation of a gate driver due to the signals of FIG. 5.

FIG. 6 is a timing diagram illustrating an example of an operation of the gate driver 150 due to the signals of FIG. 5.

Referring to FIGS. 5 and 6, the gate driver 150 includes a plurality of stages. The gate driver 150 can sequentially output a plurality of gate initialization signals GI1, GI2, . . . GIn, and a plurality of scan signals GW1, GW2, . . . GWn based at least in part on the first start signal FLM1, the first clock signal CLK1, and the second clock signal CLK2.

The gate driver 150 can output a first gate initialization signal GI1, and a first scan signal GW1 based at least in part on the first start signal FLM1 and the first and second clock signals CLK1 and CLK2. The first gate initialization signal GI1 can be obtained by shifting the first start signal FLM1 corresponding to one horizontal period 1H. At a first time point t1, the first clock signal CLK1 and the first start signal. FLM1 changes from the inactive level to the active level, and the second clock signal CLK2 changes from the active level to the inactive level. At a second time point t2, the first clock signal CLK1 changes from the active level to the inactive level, and the second clock signal CLK2 changes from the inactive level to the active level. At the second time point t2, the first start signal FLM1 changes from the active level to the inactive level, and the first gate initialization signal GI1 changes from the inactive level to the active level.

The gate driver 150 can output the second gate initialization signal GI2 and the first scan signal GW1 that are obtained by shifting the first gate initialization signal GI1 corresponding to one horizontal period 1H. Similarly, the gate driver 150 can output the third gate initialization signal GI3 and the second scan signal GW2 that are obtained by shifting the second gate initialization signal GI2 corresponding to one horizontal period 1H. An (n)th gate initialization signal can have substantially the same form as an (n−1)th scan signal.

As illustrated in FIG. 6, at a third time point t3, the first gate initialization signal GI1 changes from the active level to the inactive level, and the second gate initialization signal GI2 and the first scan signal GW1 changes from the inactive level to the active level. At a fourth time point t4, the second gate initialization signal GI2 and the first scan signal GW1 changes from the active level to the inactive level, and the third gate initialization signal GI3 and the second scan signal GW2 changes from the inactive level to the active level. At a fifth time point t5, the third gate initialization signal GI3 and the second scan signal GW2 changes from the active level to the inactive level, and a fourth gate initialization signal and a third scan signal changes from the inactive level to the active level.

Figure 7:
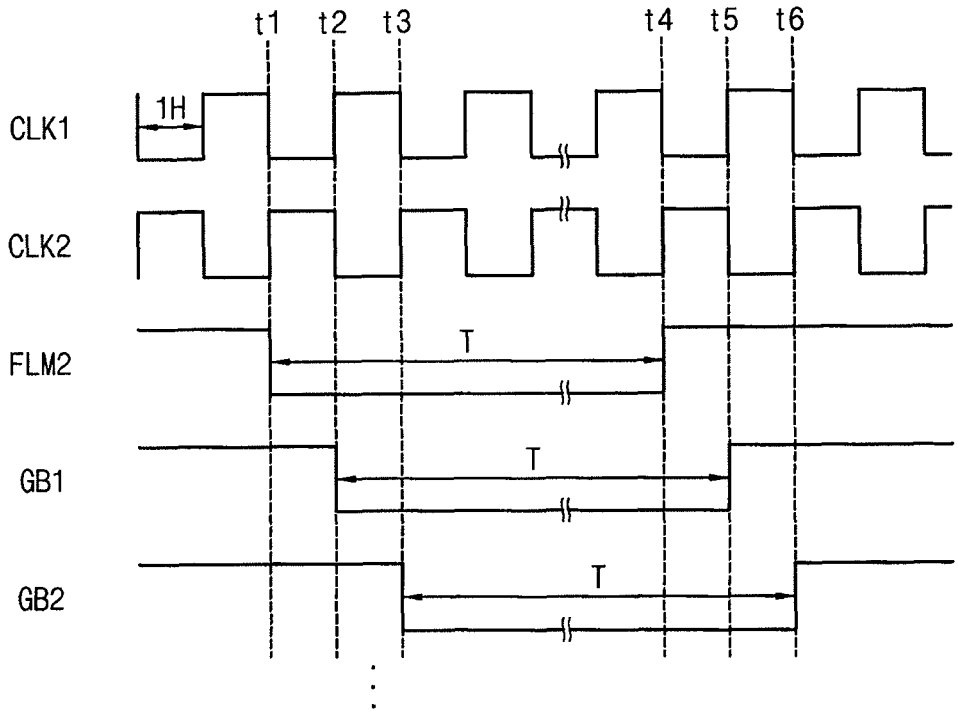
FIG. 7 is a timing diagram illustrating an example of an operation of an initialization driver due to the signals of FIG. 5.

FIG. 7 is a timing diagram illustrating an example of an operation of initialization driver 160 due to the signals of FIG. 5.

Referring to FIG. 7, the initialization driver 160 includes a plurality of stages. The initialization driver 160 can sequentially output a plurality of OLED initialization signals GB1, GB2, . . . GBn based at least in part on a second start signal FLM2, a first clock signal CLK1, and a second clock signal CLK2. In adjacent stages, the first and second clock signals CLK2 are applied in opposite sequences.

The initialization driver 160 can receive the second start signal FLM2 from the timing controller 120. In an example embodiment, a length of an active period T of the second start signal FLM2 is longer than one horizontal period 1H, and shorter than a length of the non-light emission period such that the length of the active period T of the second start signal FLM2 is longer than a length of an active period of the first start signal FLM1. The length of the active period T of the second start signal FLM2 can be adjusted by controlling the timing controller 120. A length of the active period T of the light emitting diode initialization signals GB1 to GBn can be substantially the same as the length of the active period T of the second start signal FLM2.

When the first clock signal CLK1 changes from the inactive level to the active level, the second start signal FLM2 changes from the inactive level to the active level. In an example embodiment, at a first time point t1, the first clock signal CLK1 and the second start signal FLM2 changes from the inactive level to the active level, and the second clock signal CLK2 changes from the active level to the inactive level. The length of the active period T of the second start signal FLM2 is longer than the length of the active period of the first start signal FLM1. Since these are described above referred to FIG. 4, duplicated descriptions will not be repeated.

The initialization driver 160 can output the first OLED initialization signal GB1 based at least in part on the second start signal FLM2, the first clock signal CLK1, and the second clock signal CLK2. The first OLED initialization signal GB1 can be obtained by shifting the second start signal FLM2 corresponding to one horizontal period 1H. At a first time point t1, the first clock signal CLK1 and the second start signal FLM2 changes from the inactive level to the active level, and the second clock signal CLK2 changes from the active level to the inactive level. At a second time point t2, the first clock signal CLK1 changes from the active level to the inactive level, and the second clock signal CLK2 changes from the inactive level to the active level. At the second time point t2, the first OLED initialization signal GB1 changes from the inactive level to the active level.

Similarly, the initialization driver 160 can output the second OLED initialization signal GB2 based at least in part on the first OLED initialization signal GB1, the first clock signal CLK1, and the second clock signal CLK2. At a third time point t3, the first clock signal CLK1 changes from the inactive level to the active level, and the second clock signal CLK2 changes from the active level to the inactive level. At the third time point t3, the second OLED initialization signal GB2 changes from the inactive level to the active level.

At a fourth time point t4, the second start signal FLM2 changes from the active level to the inactive level. Thus, the active period of the second start signal FLM2 can correspond to a time period between the first time point t1 and the fourth time point t4. In an example embodiment, when the first clock signal CLK1 changes from the inactive level to the active level, the second start signal FLM2 changes from the active level to the inactive level.

The first and second OLED initialization signals GB1 and GB2 can have substantially the same active periods as the length of the active period of the second start signal FLM2. Thus, at a fifth time point t5, the first OLED initialization signal GB1 changes from the active level to the inactive level. At a sixth time point t6, the second OLED initialization signal GB2 changes from the active level to the inactive level. The initialization driver 160 can sequentially output the OLED initialization signals that have the active period above 2 horizontal periods. Thus, the OLED in a pixel can be initialized in a sufficient amount of time, and the response speed of the pixel can be improved.

In an example embodiment, the initialization driver 160 includes substantially the same stage circuit as the stage circuit of the emission control driver 140. Thus, the initialization driver 160 can output the OLED initialization signal that has a longer active period than the active period of the gate initialization signal and the scan signal.

Figure 8:
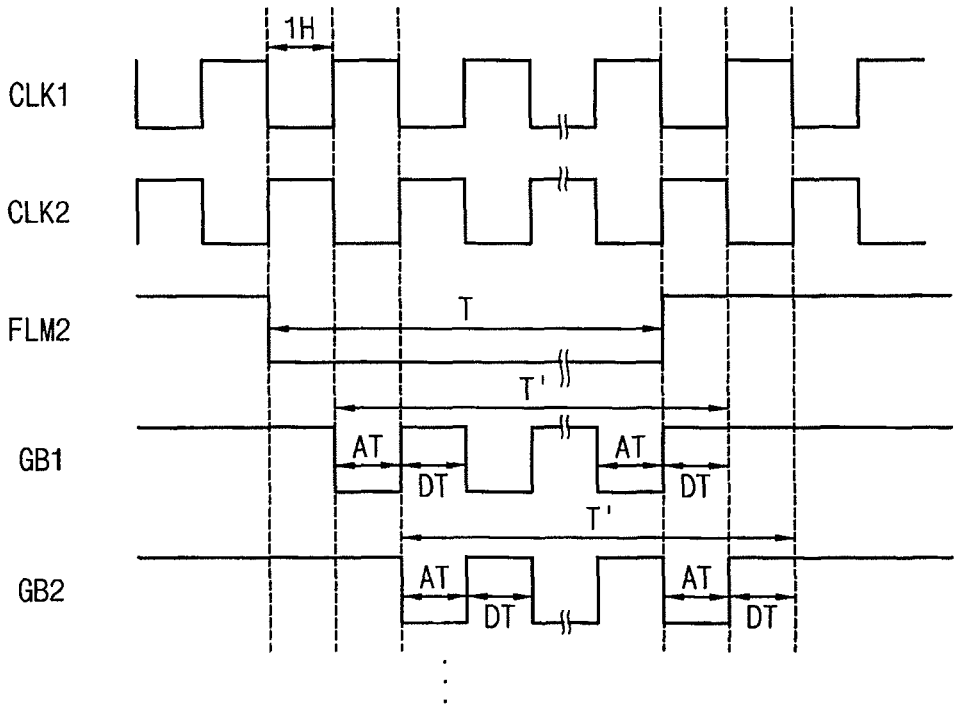
FIG. 8 is a timing diagram illustrating another example of an operation of an initialization driver due to the signals of FIG. 5.

FIG. 8 is a timing diagram illustrating another example of an operation of initialization driver 160 due to the signals of FIG. 5.

Referring to FIG. 8, the initialization driver 160 includes a plurality of stages. The initialization driver 160 can sequentially output the plurality of OLED initialization signals GB1 to GBn based at least in part on a second start signal FLM2, a first clock signal CLK1, and a second clock signal CLK2.

The initialization driver 160 can receive the second start signal FLM2 from the timing controller 120. In an example embodiment, the length of the active period T of the second start signal FLM2 is above 2 horizontal periods. The length of the active period T of the second start signal FLM2 can be adjusted by controlling the timing controller 120. Since these are described above referred to FIG. 7, duplicated descriptions will not be repeated.

In an example embodiment, a voltage level of the OLED initialization signal applied to each OLED initialization line substantially periodically transitions between the active level and the inactive level during a predetermined time T' having a length substantially the same as the length of the active period T of the second start signal FLM2. In an example embodiment, the OLED initialization signal changes from the inactive level to the active level in each horizontal period.

A first stage of the initialization driver 160 can output the first OLED initialization signal GB1 based at least in part on the second start signal FLM2, the first clock signal CLK1, and the second clock signal CLK2. The first clock signal CLK1 changes from the active level to the inactive level and the second clock signal CLK2 changes from the inactive level to the active level after one horizontal period 1H from when the second start signal FLM2 changes from the inactive level to the active level. The first OLED initialization signal GB1 changes from the inactive level to the active level after one horizontal period 1H from when the second start signal FLM2 changes from the inactive level to the active level. The first OLED initialization signal GB1 can substantially periodically change between the active level and the inactive level corresponding to the transitions of the first clock signal CLK1 and/or the second clock signal CLK2 during the predetermined time T'. A length of the active period AT of the first OLED initialization signal GB1 can be substantially the same as a length of an active period of the second clock signal CLK2 (or, length of an inactive period of the first clock signal CLK1). A length of the inactive period DT of the first OLED initialization signal GB1 can be substantially the same as a length of an active period of the first clock signal CLK1 (or, length of an inactive period of the second clock signal CLK2). In an example embodiment, the length of the active period AT and the length of the inactive period DT of the OLED initialization signal correspond to one horizontal period, during the predetermined time T'.

The length of the predetermined time T' can be substantially the same as the length of the active period T of the second start signal FLM2. In other words, for example, the sum of the active periods AT of the first OLED initialization signal GB1 in one frame can correspond to a half of the length of the active period T of the second start signal FLM2.

In an example embodiment, a second OLED initialization signal GB2 can be obtained by shifting the first OLED initialization signal GB1 corresponding to one horizontal period 1H. Thus, sum of the active periods AT of the second OLED initialization signal GB2 in one frame can correspond to the half of the length of the active period T of the second start signal FLM2. The initialization driver 160 can sequentially output the OLED initialization signals that have the active period above 2 horizontal periods. Thus, the OLED in a pixel can be initialized in a sufficient amount of time, and the response speed of the pixel can be improved.

In an example embodiment, the initialization driver 160 includes substantially the same stage circuit as the stage circuit of the gate driver 150. Thus, the initialization driver 160 can output the OLED initialization signal that substantially periodically changes between the active level and the inactive level.

Figure 9:
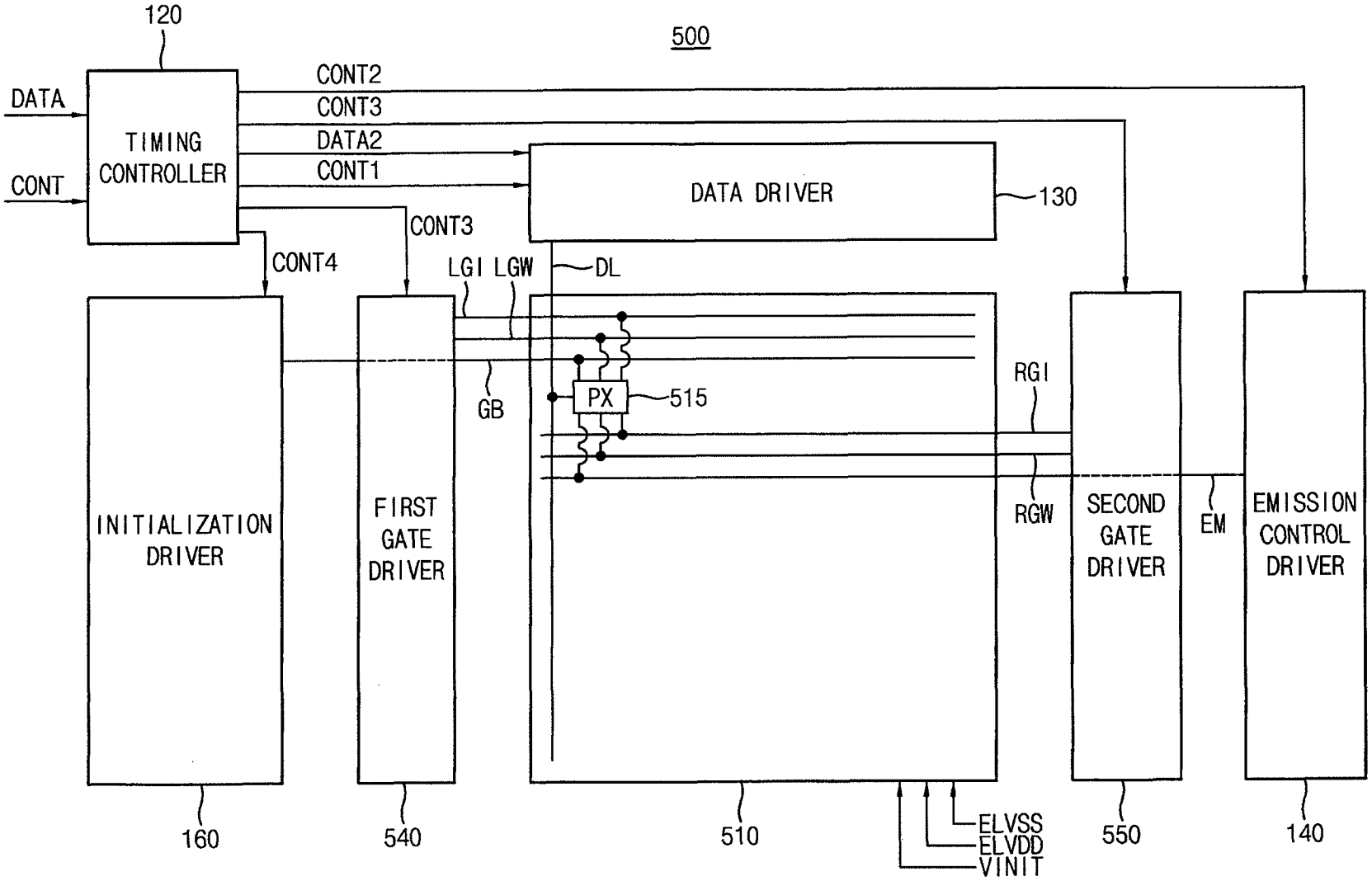
FIG. 9 is a block diagram of an OLED display according to example embodiments.

FIG. 9 is a block diagram of an OLED display 500 according to example embodiments.

Referring to FIGS. 1 and 9, the OLED display 500 includes a display panel 510, a timing controller 520, a data driver 130, an emission control driver 140, a first gate driver 540, a second gate driver 550, and an initialization driver 160. Detailed descriptions on elements and/or constructions substantially the same as or similar to those illustrated with reference to FIG. 1 are omitted. Like reference numerals are used to represent like elements.

The display panel 510 includes a plurality of left scan lines LGW, a plurality of right scan lines RGW, a plurality of left gate initialization lines LGI, a plurality of right gate initialization lines RGI, a plurality of OLED initialization lines GB, a plurality of emission control lines EM, a plurality of data lines DL, and a plurality of pixels 515 respectively having a plurality of OLEDs. The pixels 515 can be formed in a matrix form. In an example embodiment, the number of the left scan lines LGW, right scan lines RGW, left gate initialization lines LGI, right gate initialization lines RGI, OLED initialization lines GB, and emission control lines EM is n (n is an integer greater than zero.). The number of the data lines DL is m (m is an integer greater than zero.). In an example embodiment, the number of the pixels 115 is n×m.

The timing controller 520 can control the data driver 130, the emission control driver 140, the first gate driver 540, the second gate driver 550 and the initialization driver 160. The timing controller 520 can generate a data signal DATA2 which has a digital type and corresponds to operating conditions of the display panel 110 based at least in part on the input image signal DATA. The timing controller 120 can generate a first control signal CONT1 to control a driving timing of the data driver 130 based at least in part on the input control signal CONT. The timing controller 520 can generate a second control signal CONT2 to control a driving timing of the emission control driver 140. The timing controller 120 can apply the second control signals CONT2 to the emission control driver 140.

The timing controller 520 can substantially simultaneously output a third control signal CONT3 to the first gate driver 540 and the second gate driver 550. The third control signal can include a first start signal, a first clock signal, and a second clock signal.

The timing controller 520 can output a fourth signal CONT4 to the initialization driver 160. The fourth control signal CONT4 can include a second start signal, the first clock signal, and the second clock signal.

In an example embodiment, the timing controller 520 substantially simultaneously outputs the first start signal having an active period corresponding to one horizontal period to the first and second gate drivers 150, and outputs the second start signal having the active period to the initialization driver 160 after a certain time from when the timing controller 520 outputs the first start signal having the active level. The one horizontal period can be defined as a shift period between the first clock signal and the second clock signal. In an example embodiment, the first and second clock signals have substantially the same period, and the second clock signal are obtained by shifting the first clock signal by half of a period of the first clock signal. A length of one horizontal period can be adjusted by a drive frequency of the OLED display 500.

A length of an active period of the second start signal can be longer than a length of an active period of the first start signal. In an example embodiment, the length of the active period of the second start signal is longer than one horizontal period, and shorter than a length of a non-light emission period. For example, if the length of the non-light emission period is about 50 horizontal periods, the active period of the second start signal corresponds to a period between 2 horizontal periods and 48 horizontal periods.

The first gate driver 540 can receive the first start signal, sequentially apply a left gate initialization signal to the left gate initialization lines LGI based at least in part on the first start signal, and sequentially apply a left scan signal to the left scan lines LGW based at least in part on the first start signal.

The second gate driver 550 can receive the first start signal, sequentially apply a right gate initialization signal to the right gate initialization lines RGI based at least in part on the first start signal, and sequentially apply a right scan signal to the right scan lines RGW based at least in part on the first start signal.

In an example embodiment, the left gate initialization signal is substantially the same as the right gate initialization signal and the left scan signal is substantially the same as the right scan signal.

In an example embodiment, the first gate driver 540 is located on the left side of the display panel 510, and the second gate driver 550 is located on the right side of the display panel 510. In an example embodiment, the first gate driver 540 has substantially the same stage circuits as the second gate driver 550. The first and second gate drivers 540 and 550 substantially simultaneously receive the third control signal CONT3 such that the first and second gate drivers 540 and 550 output substantially the same signals at substantially the same time. The display panel 510 can receive the gate initialization signals and the scan signals from both sides. In an example embodiment, an (n)th left scan signal and an (n)th right scan signal substantially simultaneously have the active level when an (n)th left gate initialization signal and an (n)th right gate initialization signal change from the active level to the inactive level. Thus, the pixels in the display panel 510 corresponding to an (n)th left scan line, an (n)th right scan line, an (n)th left gate initialization line, and an right gate initialization line substantially simultaneously receive the gate initialization signals from both sides and substantially simultaneously receive the scan signals from both sides. Therefore, RC time delay caused by loads and/or parasitic capacitances of signal lines in the display panel 510 can decrease.

The initialization driver 160 can receive the fourth control signal CONT4 including the second start signal, the first clock signal, and the second clock signal and sequentially apply an OLED initialization signals to the OLED initialization lines GB based at least in part on the fourth control signal CONT4.

In an example embodiment, a length of an active period of the OLED initialization signals is substantially the same as the length of the active period of the second start signal. Thus, the OLED can be initialized in a sufficient amount of time, and the residual voltage that has been applied to the OLED during the previous frame can be fully discharged. In another example embodiment, a voltage level of the OLED initialization signal applied to each OLED initialization line substantially periodically transitions between the active level and the inactive level during a predetermined time having a length substantially the same as the length of the active period of the second start signal. Each active period and inactive period of the OLED initialization signal can correspond to one horizontal period. Thus, the OLED can be initialized in a sufficient amount of time, and residual voltage that has been applied to the OLED during the previous frame can be fully discharged. However, these are examples, and the length of the active period of the OLED initialization signal and the length of the inactive period of the OLED initialization signal are not limited thereto.

In an example embodiment, when the left and right scan signals applied to the one of the left scan lines LGW and the one of the right scan lines RGW reach inactive levels, the initialization driver 160 outputs the OLED initialization signal having the active level to one of the OLED initialization lines GB corresponding to one of the left scan lines LGW and one of the right scan lines RGW. The pixel 515 can sequentially receive the gate initialization signal, the scan signal, and the OLED initialization signal.

As described above, the OLED display 500 of FIG. 9 includes the initialization driver 160 independently operated from the first and second gate drivers 540 and 550. The initialization driver 160 can output the OLED initialization signal based at least in part on the second start signal, and the length of the active period of the OLED initialization signal can be longer than the length of the active period of the gate initialization signal and the scan signal. Therefore, the response speed of the pixel 515 and an image blur problem can be improved. The response speed of the pixel emitting a green light that is most affected by the drive frequency can be greatly improved.

In addition, the first and second drivers 540 and 550 can substantially simultaneously apply the left and right gate initialization signals and substantially simultaneously apply the left and right scan signals to the display panel 510. Thus, RC time delay caused by loads and/or parasitic capacitances of signal lines in the display panel 510 can decrease.

Figure 10:
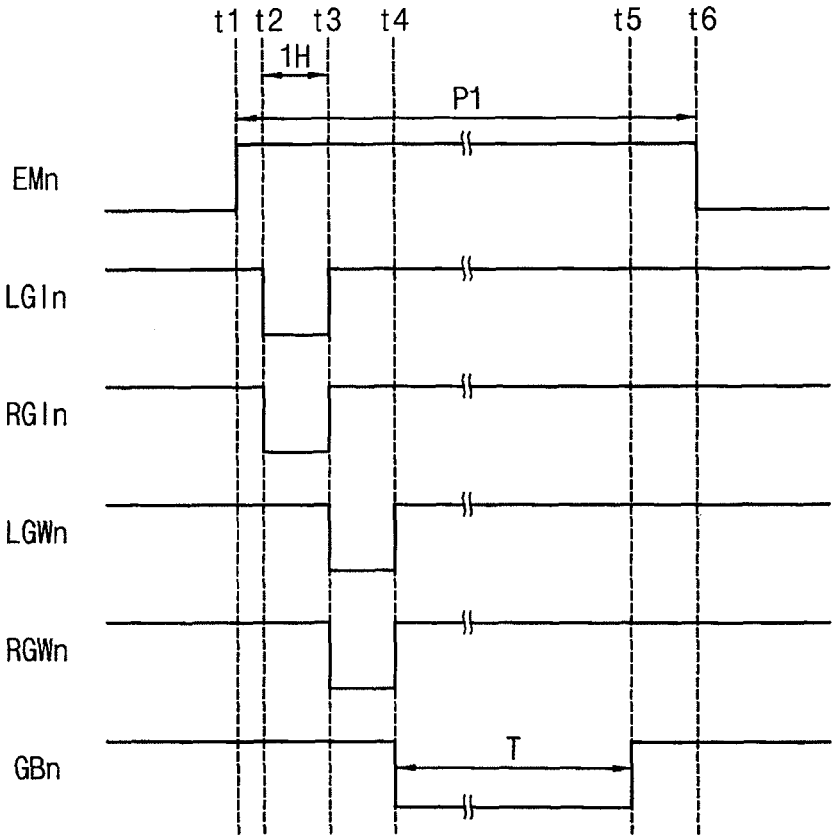
FIG. 10 is a timing diagram illustrating an example of signals applied to a display panel included in the OLED display of FIG. 9.
Figure 11:
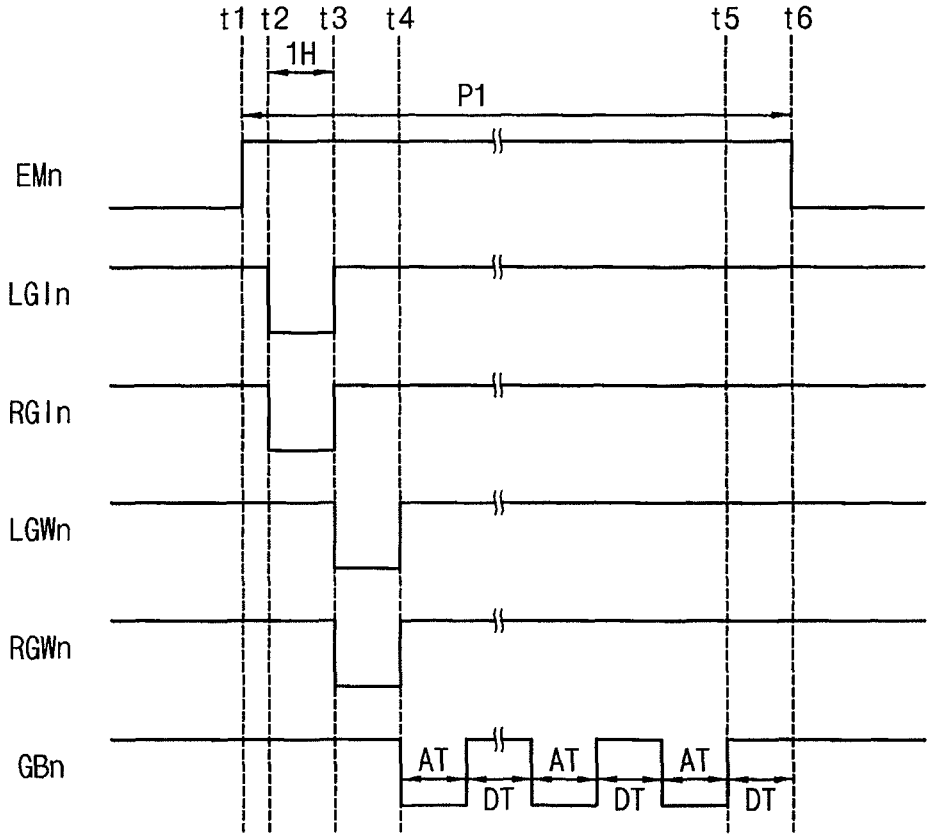
FIG. 11 is a timing diagram illustrating another example of signals applied to a display panel included in the OLED display of FIG. 9.

FIG. 10 is a timing diagram illustrating an example of signals applied to the display panel 510 included in the OLED display 500 of FIG. 9. FIG. 11 is a timing diagram illustrating another example of signals applied to the display panel 510 included in the OLED display 500 of FIG. 9.

Referring to FIGS. 10 and 11, an (n)th (n is a integer greater than 0) left gate initialization signal LGIn, an (n)th right gate initialization signal RGIn, an (n)th left scan signal LGWn, an (n)th right scan signal RGWn, and an (n)th OLED initialization signal GBn are sequentially applied to pixels arranged in a corresponding row during a non-light emission period P1 of one frame. The (n)th left gate initialization signal LGIn and the (n)th left scan signal LGWn can be generated in an (n)th stage of the first gate driver 540. The (n)th right gate initialization signal RGIn and the (n)th right scan signal RGWn can be generated in an (n)th stage of the second gate driver 550. The (n)th OLED initialization signal GBn can be generated in an (n)th stage of the initialization driver 160. In an example embodiment, the (n)th left gate initialization signal LGIn substantially the same as the (n)th right gate initialization signal RGIn. The first and second gate drivers 540 and 550 can substantially simultaneously output the (n)th left gate initialization signal LGIn and the (n)th right gate initialization signal RGIn, respectively. Similarly, the (n)th left scan signal LGWn can be substantially the same as the (n)th right scan signal RGWn. The first and second gate drivers 540 and 550 can substantially simultaneously output the (n)th left scan signal LGWn and the (n)th right scan signal RGWn, respectively.

In an example embodiment, the (n)th left scan signal LGWn and the (n)th right scan signal RGWn substantially simultaneously have the active level when the (n)th left gate initialization signal LGIn and the right gate initialization signal RGIn change from the active level to the inactive level. Thus, pixels in the display panel 510 corresponding to the (n)th left scan signal LGWn, the (n)th right scan signal RGWn, the (n)th left gate initialization signal LGIn, and the right gate initialization signal RGIn can substantially simultaneously receive the gate initialization signals from both sides and substantially simultaneously receive the scan signals from both sides.

As illustrate in FIGS. 10 and 11, at a first time point t1, the (n)th emission control signal EMn changes from the active level to the inactive level. Thus, the non-light emission period starts from the first time point t1.

At a second time point t2, the (n)th left gate initialization signal LGIn and the right gate initialization signal RGIn change from the active level to the inactive level. An active period of the (n)th left gate initialization signal LGIn and the right gate initialization signal RGIn correspond to one horizontal period 1H. The one horizontal period 1H corresponds to a half of a period of the first clock signal (or the second clock signal). The (n)th left gate initialization signal LGIn and the right gate initialization signal RGIn change from the active level to the inactive level after one horizontal period 1H from the second time point t2. In an example embodiment, the second time point t2 is the same as the first time point t1.

At a third time point t3, the (n)th left gate initialization signal LGIn and the right gate initialization signal RGIn change from the active level to the inactive level, and the (n)th left scan signal. LGWn and the (n)th right scan signal RGWn change from the inactive level to the active level. The (n)th OLED initialization signal GBn can still have the inactive level. An active period of (n)th left scan signal LGWn and the (n)th right scan signal RGWn can correspond to one horizontal period 1H.

As illustrated in FIG. 10, at a fourth time point t4, the (n)th left scan signal LGWn and the (n)th right scan signal RGWn change from the active level to the inactive level, and the (n)th OLED initialization signal GBn change from the inactive level to the active level. The (n)th left gate initialization signal LGIn and the right gate initialization signal RGIn can have the inactive level.

At a fifth time point t5, the (n)th OLED initialization signal GBn changes from the active level to the inactive level. An active period of the (n)th OLED initialization signal GBn corresponds to a time period from the fourth time point t4 to the fifth time point t5. In an example embodiment, the length of the active period of the (n)th OLED initialization signal GBn (as represented T) is above 2 horizontal periods and below the length of the non-light emission period P1 minus 2 horizontal periods.

As illustrated in FIG. 11, during a time period between the fourth time point t4 and the fifth time point t5, the initialization driver 160 outputs the (n)th OLED initialization signal GBn that substantially periodically transitions between the active level and the inactive level. In an example embodiment, the length of the active period AT and the length of the inactive period DT of the OLED initialization signal respectively correspond to one horizontal period.

The active period of the (n)th OLED initialization signal GBn is longer than the typical active period, so that the OLED of the pixel can be initialized in a sufficient amount of time, and the residual voltage that has been applied to the OLED during the previous frame can be fully discharged.

As illustrated in FIGS. 10 and 11, at a sixth time point t6, the (n)th emission control signal EMn changes from the inactive level to the active level.

The active period of the OLED initialization signal GBn is longer than the scan signals LGWn and RGWn and the gate initialization signals LGIn and RGIn such that the OLED of the pixel can be initialized in a sufficient amount of time, and the residual voltage that has been applied to the OLED during the previous frame can be fully discharged.

The present embodiments can be applied to any display device and any system including the display device. For example, the present embodiments are applied to televisions, computer monitors, laptop computers, digital cameras, cell phones, smartphones, tablet computers, personal digital assistants (PDAs), portable multimedia players (PMPs), MP3 players, navigation systems, game consoles, video phones, etc.

The foregoing is illustrative of example embodiments, and is not to be construed as limiting thereof. Although the inventive technology has been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An organic light-emitting diode (OLED) display comprising:

a display panel including a plurality of scan lines, a plurality of gate initialization lines, a plurality of OLED initialization lines, a plurality of emission control lines, a plurality of data lines, and a plurality of pixels respectively including a plurality of OLEDs;

a data driver configured to respectively apply a plurality of data signals to the data lines;

an emission control driver configured to sequentially apply an emission control signal to the emission control lines, wherein the emission control signal is configured to determine a light emission period and a non-light emission period;

a timing controller configured to output a first start signal having a first active period and a second start signal having a second active period;

a gate driver configured to i) receive the first start signal from the timing controller, ii) sequentially apply a gate initialization signal to the gate initialization lines based at least in part on the first start signal, and iii) sequentially apply a scan signal to the scan lines; and an initialization driver configured to receive the second start signal and sequentially apply an OLED initialization signal to the OLED initialization lines based at least in part on the second start signal, wherein the second active period is longer than the first active period.

2. The device of claim 1, wherein the OLED initialization signal has a third active period having substantially the same duration as the second active period.

3. The device of claim 2, wherein the first active period corresponds to one horizontal period.

4. The device of claim 3, wherein the timing controller is further configured to output the second start signal two horizontal periods after the first start signal is output.

5. The device of claim 3, wherein, when the gate initialization signal applied to a selected one of the gate initialization lines changes to an inactive level, the gate driver is further configured to transmit the scan signal to a selected one of the scan lines corresponding to the selected gate initialization line.

6. The device of claim 5, wherein, when the scan signal applied to the selected scan line changes to the inactive level, the initialization driver is further configured to transmit the OLED initialization signal to one of the OLED initialization lines corresponding to the selected scan line.

7. The device of claim 2, wherein the second active period is longer than one horizontal period and shorter than the non-light emission period.

8. The device of claim 1, wherein the initialization driver is further configured to change a voltage level of the OLED initialization signal substantially periodically between the active level and the inactive level during a predetermined time substantially the same as the second active period.

9. The device of claim 8, wherein the initialization driver is further configured to sequentially change a plurality of the OLED initialization signals from the inactive level to the active level every horizontal period.

10. The device of claim 9, wherein the timing controller is further configured to transmit the first start signal to the gate driver and the second start signal to the initialization driver.

11. The device of claim 10, wherein the timing controller is further configured to transmit the second start signal two horizontal periods after the first start signal is output.

12. The device of claim 10, wherein, when the gate initialization signal applied to a selected one of the gate initialization lines changes to the inactive level, the gate driver is further configured to transmit the scan signal to a selected one of the scan lines corresponding to the selected gate initialization line.

13. The device of claim 12, wherein, when the scan signal applied to the selected scan line changes to the inactive level, the initialization driver is further configured to transmit the OLED initialization signal to one of the OLED initialization lines corresponding to the selected scan line.

14. The device of claim 9, wherein the second active period is longer than one horizontal period and shorter than the non-light emission period.

15. An organic light-emitting diode (OLED) display comprising:

a display panel including a plurality of first scan lines, a plurality of second scan lines, a plurality of first gate initialization lines, a plurality of second gate initialization lines, a plurality of OLED initialization lines, a plurality of emission control lines, a plurality of data lines, and a plurality of pixels respectively including a plurality of OLEDs;

a data driver configured to respectively apply a plurality of data signals to the data lines;

an emission control driver configured to sequentially apply an emission control signal to the emission control lines, wherein the emission control signal is configured to determine a light emission period and a non-light emission period;

a timing controller configured to output a first start signal having a first active period and a second start signal having a second active period;

a first gate driver configured to i) receive the first start signal from the timing controller, ii) sequentially apply a first gate initialization signal to the first gate initialization lines based at least in part on the first start signal, and iii) sequentially apply a first scan signal to the first scan lines;

a second gate driver configured to i) receive the first start signal, ii) sequentially apply a second gate initialization signal to the second gate initialization lines based at least in part on the first start signal, and iii) sequentially apply a second scan signal to the second scan lines;

an initialization driver configured to receive the second start signal and sequentially apply an OLED initialization signal to the OLED initialization lines based at least in part on the second start signal, wherein the second active period is longer than first active period.

16. The device of claim 15, wherein an active period of the OLED initialization signal is substantially the same as the second active period of the second start signal.

17. The device of claim 16, wherein the timing controller is further configured to substantially simultaneously transmit the first start signal to the first and second gate drivers, and wherein the timing controller is further configured to transmit the second start signal two horizontal periods after the first start signal is output.

18. The device of claim 17, wherein the first and second gate drivers are further configured to substantially simultaneously transmit the first and second scan signals to a selected one of the first scan lines and one of the second scan lines, respectively, and wherein, when the first and second scan signals applied to the selected first and second scan lines become inactive levels, the initialization driver is configured to output the OLED initialization signal having the active level to one of the OLED initialization lines corresponding to the selected first and second scan lines.

19. The device of claim 16, wherein the second active period is longer than one horizontal period, and shorter than the non-light emission period.

20. The device of claim 15, wherein the initialization driver is further configured to change a voltage level of the OLED initialization signal substantially periodically between an active level and an inactive level during a predetermined time substantially the same as the second active period, and wherein the second active period is longer than one horizontal period and shorter than the non-light emission period.

* * * * *